United States Patent [19]

English

[11] 4,172,337

[45] Oct. 30, 1979

[54] FOLDED GLIDER AND METHOD OF MAKING SAME

[76] Inventor: Roy L. English, 2733 SE. 31st, Portland, Oreg. 97202

[21] Appl. No.: 838,898

[22] Filed: Oct. 3, 1977

[51] Int. Cl.[2] ..... A63H 33/16

[52] U.S. Cl. ..... 46/79

[58] Field of Search ..... 46/16, 79, 80, 81

[56] References Cited

U.S. PATENT DOCUMENTS

| | | | |
|---|---|---|---|
| 3,010,250 | 11/1961 | Huston | 46/79 |
| 3,729,862 | 5/1973 | Halsey | 46/79 |

*Primary Examiner*—Louis G. Mancene
*Assistant Examiner*—Robert F. Cutting
*Attorney, Agent, or Firm*—Chernoff & Vilhauer

[57] ABSTRACT

A folded glider is comprised of a sheet of material having a center hinge line which is located along its medial axis and paired side hinge lines which are located generally parallel to the center hinge line at spaced intervals outwardly therefrom. A slit is located in the sheet of material, extending transversely between the side hinge lines proximate the trailing edge of the glider. The glider is formed by folding the sheet of material upwardly along the portion of the center hinge line lying forwardly of the slit to form a fuselage, folding it downwardly along the portions of the side hinge lines lying forwardly of the slit to form wings, and folding it upwardly along the portions of the side hinge lines lying rearwardly of the slit and downwardly along the portion of the center hinge line lying rearwardly of the slit to form an inverted "V"-shaped vertical tail. In another embodiment of the glider, the side hinge lines do not extend forwardly of the slit so that when the glider is folded, the wings and fuselage remain coplanar. A third embodiment has two parallel sets of side hinge lines allowing tighter folding of the glider along the center hinge line to alter its weight distribution. Another embodiment has the slit angled rearwardly between each side hinge line and the center hinge line so that the resulting triangle it outlines can be folded forwardly to shift the center of gravity of the glider toward its leading edge. In several of the embodiments the glider is shaped so that a plurality of them can be fabricated from a single sheet of material with little or no wastage of material.

3 Claims, 18 Drawing Figures

FIG. 8
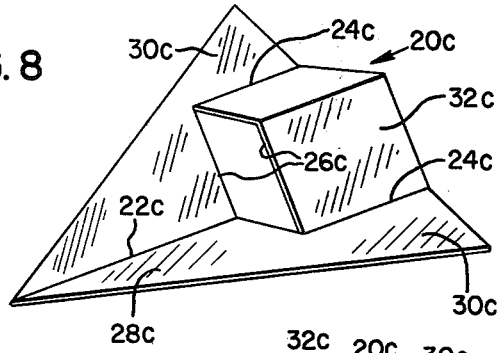
FIG. 4
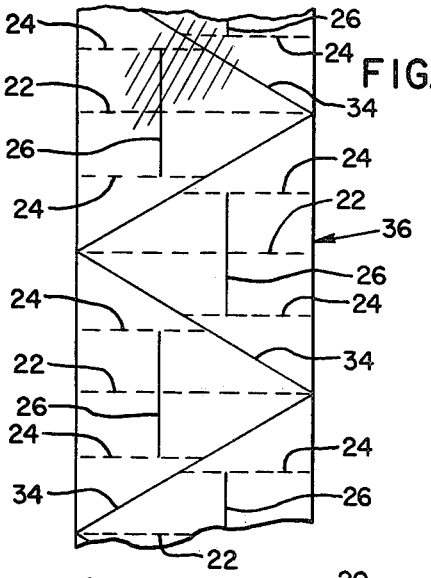
FIG. 9
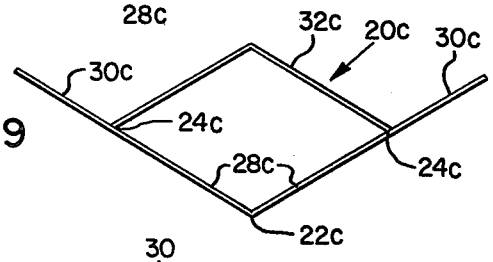
FIG. 2
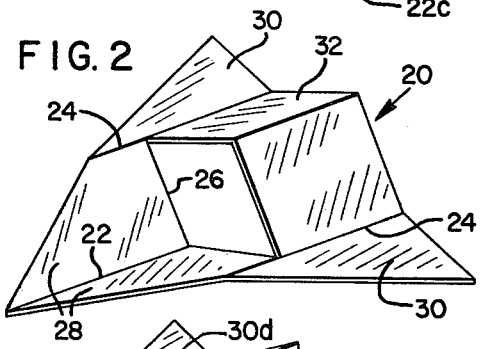
FIG. 1
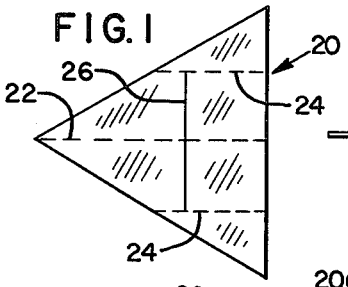
FIG. 3
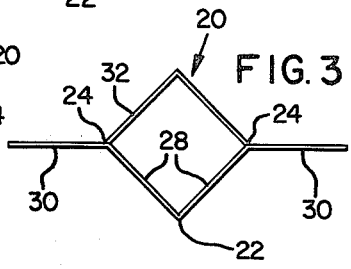
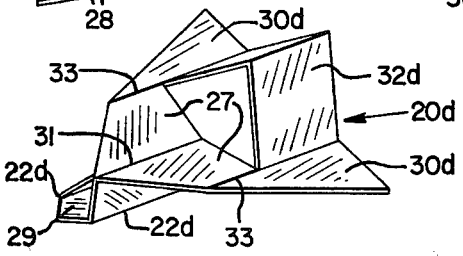
FIG. 11
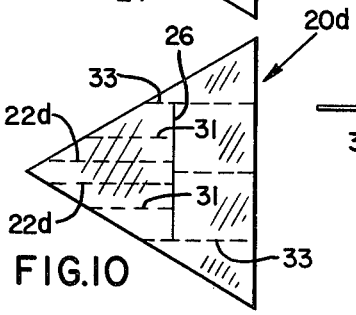
FIG. 10
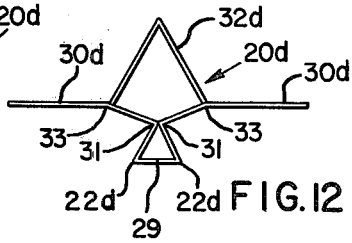
FIG. 12
FIG. 13
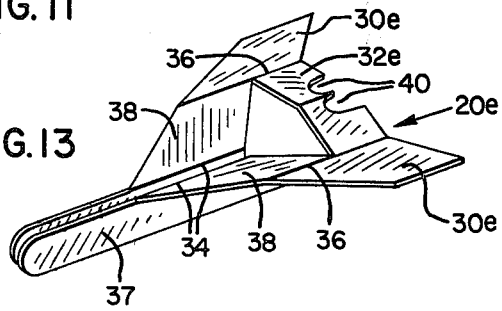
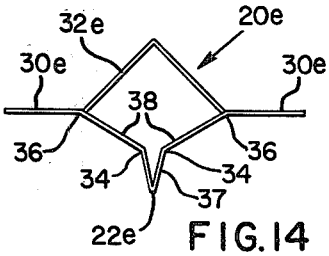
FIG. 14
FIG. 15
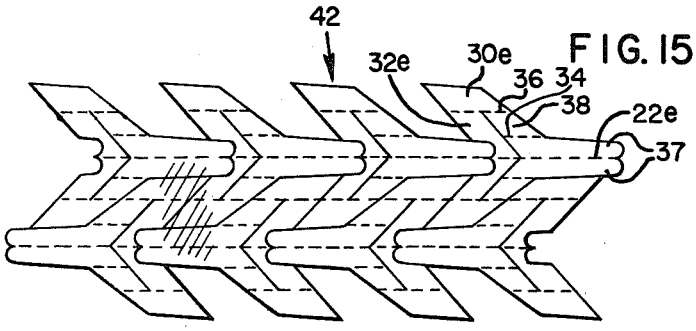

FOLDED GLIDER AND METHOD OF MAKING SAME

BACKGROUND OF THE INVENTION

This invention is related to a folded glider and the method of making it.

Folded gliders, constructed both from paper and other lightweight materials, are legion in the prior art. However, the prior art gliders have either been unduly complex to construct or else have had poor aerodynamic qualities. In addition, if they are formed by the use of a simple fold pattern, they require the addition of a selectively placed weight to give them proper balance and thereby prevent them from repeatedly stalling when in flight.

SUMMARY OF THE INVENTION

The glider of the principal invention is formed from a planar sheet of material having a center hinge line located along a medial axis and paired side hinge lines located generally parallel to the center hinge lines at spaced intervals from it. A slit is located in the material, extending transversely between the side hinge lines near the trailing edge of the glider. The sheet of material from which the glider is formed can have any overall shape, however, if the glider is triangular shaped a plurality of them can readily be formed from a single sheet of material in a single stamping operation.

The glider is formed by folding the sheet of material upwardly along the portion of the center hinge line lying forwardly of the slit to form a fuselage, folding it downwardly along the portions of the side hinge lines lying forwardly of the slit to form wings, and folding it upwardly along the portions of the side hinge lines lying rearwardly of the slit and downwardly along the portion of the center hinge line lying rearwardly of the slit to form an inverted "V"-shaped vertical tail.

In a variation of this embodiment, the side hinge lines do not extend forwardly of the slit, so that when the glider is folded the wing and fuselage remain coplanar.

Another embodiment of the glider utilizes two sets of paired side hinge lines, thereby allowing the fold along the center hinge line to be made tighter. In a variation of this embodiment the piece of material from which the glider is formed is shaped so that in the resulting glider the fuselage portion lying between the inner side hinge lines and the center hinge line extends forwardly of the remainder of the fuselage and the wings in order to shift the weight of the glider forwardly, thereby allowing it to fly stably without the addition of weights.

In the last embodiment of the glider the slit is angled rearwardly between the side hinge lines and the center hinge line so that a triangular flap is formed. By folding this flap forwardly, causing the portion of the center hinge line extending throught the flap to overlie the remainder of the center hinge line, the weight of the glider is shifted forwardly so that additional weights are not required.

In this last embodiment, a tab can be formed in the flap adjacent to the center hinge line and a slot can be cut in the fuselage along the center hinge line in a manner so that the tab fits throught the slot when the flap is folded forward. Thus the flap is secured to the fuselage and the tab extends downwardly from the glider for use as an aid in launching it.

The forgoing objectives, features and advantages of the present invention will be more readily understood upon consideration of the following detailed description of the invention taken in conjunction with the accompanying drawings.

BRIEF DESCRIPTION OF THE DRAWINGS

FIG. 1 is a plan view of a flat pattern showing a preferred embodiment of the glider of the present invention.

FIG. 2 is a pictorial view showing the glider of FIG. 1 when folded.

FIG. 3 is an end elevational view of the glider of FIG. 2.

FIG. 4 is a plan view showing the layout of a plurality of the flat patterns of FIG. 1 on a single sheet of material.

FIG. 8 is a pictorial view showing another embodiment of the glider.

FIG. 9 is an end elevational view of the embodiment shown in FIG. 8.

FIG. 10 is a plan view showing the flat pattern of still another embodiment of the glider.

FIG. 11 is a pictorial view showing the glider of FIG. 10 in a folded orientation.

FIG. 12 is an end elevational view of the glider of FIG. 11.

FIG. 13 is a pictorial view showing still another embodiment of the glider.

FIG. 14 is an end elevation view of the glider of FIG. 13.

FIG. 15 is a plan view showing a plurality of the flat patterns of the glider of FIG. 13 on a single sheet of material.

DETAILED DESCRIPTION OF THE INVENTION

Figure 6:
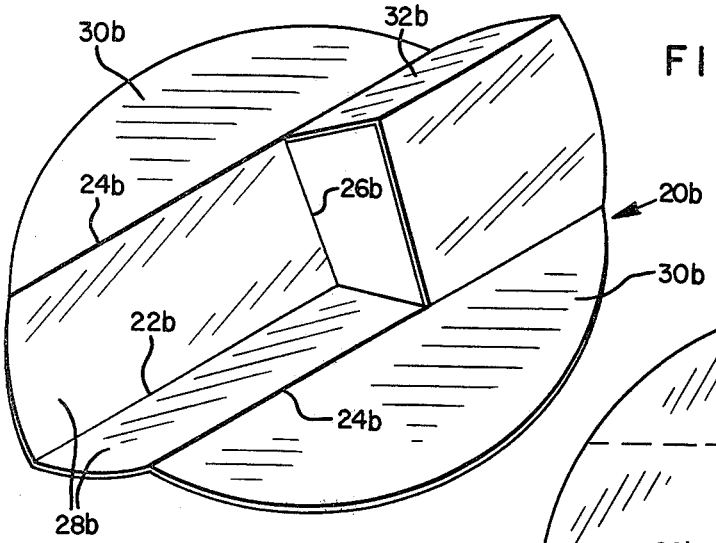
FIG. 6 is a pictorial view of the glider of FIG. 5 when folded.

Referring to the drawings, the basic configuration of the invention is shown in FIGS. 1, 2, and 3. In this embodiment the glider 20 has a center hinge line 22 which lies along a medial axis of the sheet of material from which the glider is formed. Located outwardly of the center hinge line on each side thereof, are paired side hinge lines 24 which are generally parallel to the center hinge line. However, if desired the side hinge lines can be angled either inwardly or outwardly up to an angle of 10° without destroying the aerodynamic performance of the glider. In fact, the angles of the side hinge lines can be used to aerodynamically counteract the effect of balancing forces on the glider in flight. A slit 26 is formed transversely in the glider near its trailing edge, between the side hinge lines. Accordingly the basic flat or unfolded pattern of the glider shown in FIG. 1 is formed.

The folded glider shown in FIGS. 2 and 3 is formed from the above-described flat pattern by first folding the sheet of material upwardly along the portion of the center hinge line lying forwardly of slit 26 thereby forming a fuselage 28. The glider is then folded downwardly along the portions of the side hinge lines lying forwardly of the slits to form paired wings 30. Finally, it is folded upwardly along the portions of the side hinge lines lying rearwardly of the slit and downwardly along the portion of the center hinge line lying rearwardly of the slit to form an inverted "V"-shaped vertical tail 32.

Figure 5:
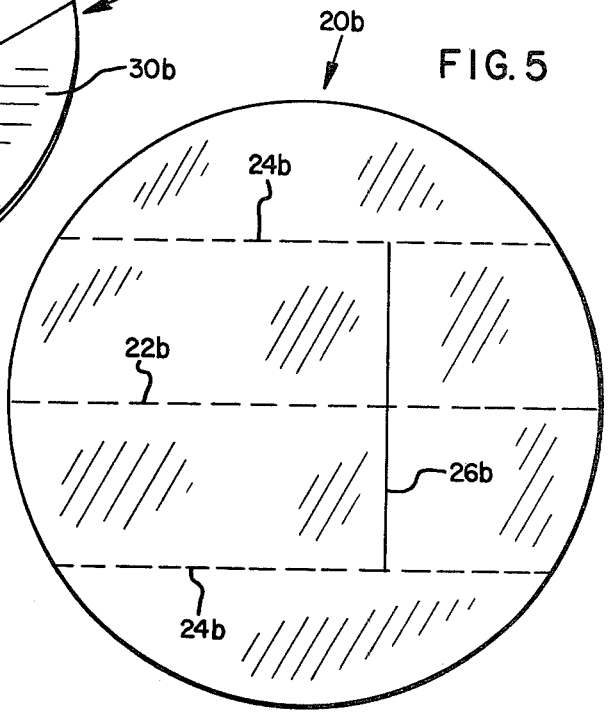
FIG. 5 is a plan view of the flat pattern showing another embodiment of the glider.
Figure 7:
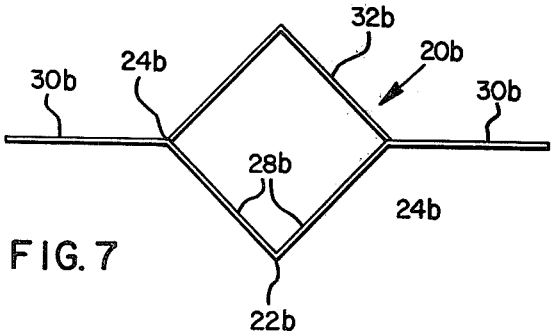
FIG. 7 is an end elevational view of the glider of FIG. 6.

In the embodiment illustrated in FIGS. 1, 2 and 3, the sides of the glider are angled to form a pointed leading edge giving the glider a triangular shape. However, this shape is optional and not per-se a feature of the invention. Referring to FIGS. 5, 6 and 7, a circular glider **20*b*** is shown formed from a disc-shaped sheet of material utilizing the above-described hinge lines and folds. Other shaped sheets of material likewise can be used as will be noted later.

However, the triangular shape shown in FIGS. 1, 2 and 3 allows mass forming of the gliders by making a zig-zag cut or perforation 34 in an elongate sheet of material 36, FIG. 4. The hinge lines 22 and 24 respectively are formed by scoring the material between the triangles thus formed, and slits 26 are cut in the appropriate locations between the pair of side hinge lines. Accordingly, multiple flat patterns can be formed in a single stamping operation.

Another embodiment of the glider **10*c* is shown in FIGS. 8 and 9 wherein the side hinge lines 24*c* do not extend forwardly of slit 26*c*. Therefore, when the glider is folded, wings 30*c* remain coplanar with fuselage 28*c***.

Another embodiment of the glider **20*d*, shown in FIGS. 10, 11 and 12, has paired center hinge lines 22*d*. Located at spaced intervals outwardly of the respective center hinge lines are paired first side hinge lines 31 and paired second side hinge lines 33**.

In this embodiment the glider is folded upwardly along the portions of both center hinge lines **22*d* lying forwardly of slit 26, and downwardly along the portions of the first and second side hinge lines lying forwardly of the slit. The tail 32*d* in this embodiment is formed in the same manner as in the previous one. Thus a lower fuselage 29 having a triangular cross section is formed, along with an upper fuselage 27**.

Yet another embodiment of the glider **20*e* is shown in FIGS. 13 and 14. In this embodiment, there again are paired first side hinge lines 34 and paired second side hinge lines 36 which are parallel to and separated from each other, however in this embodiment there is one center hinge line 22*e*. The glider is folded along the center hinge line 22*e* and downwardly along both sets of the side hinge lines forming both a lower fuselage 37 and an upper fuselage 38, thereby allowing the fold formed along the center hinge line to be made tighter than in the other embodiments in order to concentrate the weight of the glider closer to its vertical center line. The tail 32*e*** of this embodiment is the same as in the previous embodiments.

In this embodiment the edges of the sheet of material from which the glider is formed have been trimmed to give an elongated lower fuselage 37 which extends forwardly of the upper fuselage 38 and which has a rounded leading edge, thereby concentrating the weight further forwardly of the wing than in the other configuration to allow it to be flown without the addition of weights. In this configuration the trailing edge of wings **30*e* are angled rearwardly, and the tail 32*e* has paired scallops 40 which are shaped like the curved leading edge of lower fuselage 37. Accordingly, multiple flat patterns of this embodiment can be cut from a single sheet of material 42, FIG. 15**, by reversing every other row of gliders with respect to its adjacent row.

Figure 17:
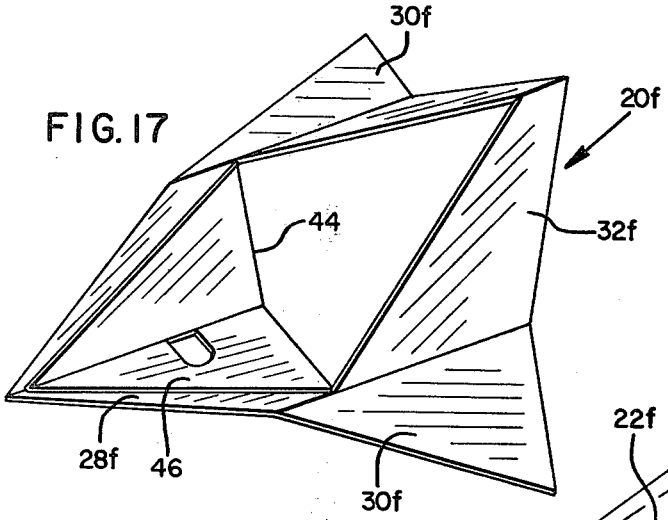
FIG. 17 is a pictorial view of the glider of FIG. 16 when folded.
Figure 16:
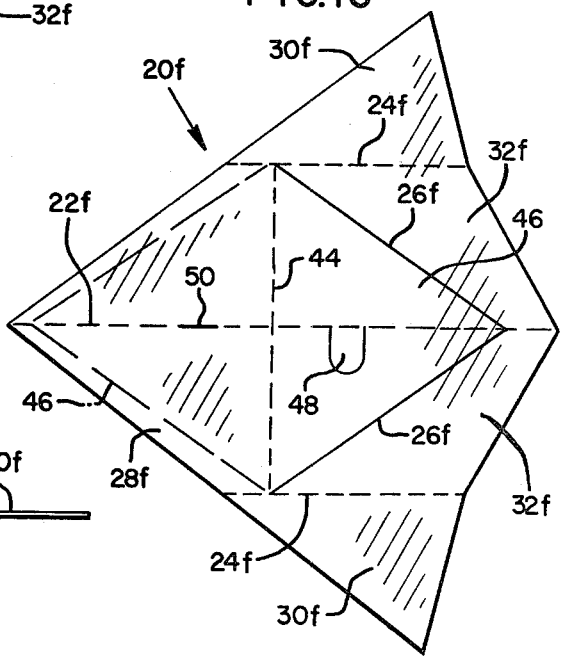
FIG. 16 is a plan view showing the flat pattern of yet another embodiment of the glider.
Figure 18:
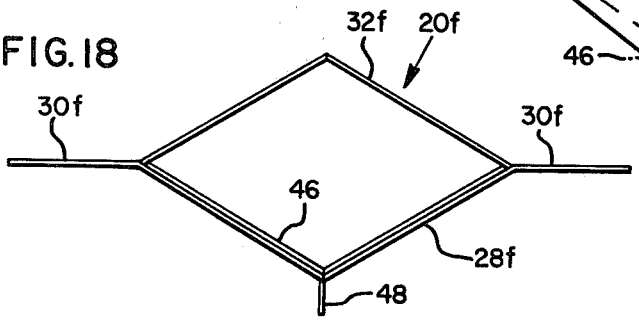
FIG. 18 is an end elevational view of the glider of FIG. 17.

The last embodiment of the glider **20*f* is shown in FIGS. 16, 17, and 18. This embodiment employs the same center hinge line 22*f* and side hinge lines 24*f* as the basic embodiment (FIGS. 1, 2 and 3) except that slit 26*f* is angled rearwardly from each of the side hinge lines to a common point on the center hinge line. Thus by forming a fold line 44 extending between the outer ends of the slit, a triangular flap 46 is created. When flap 46** is folded forwardly, so that the center hinge line overlies itself, the center of gravity of the glider again is shifted forward thereby improving the balance of the glider and allowing it to be flown without the addition of weights.

A tab 48 is formed in the flap adjacent to the center hinge line and a slot 50 is placed in the center hinge line at a location which is the same distance forwardly of fold line 44 as tab 48 is rearwardly of it. Thus when the flap is folded, tab 48 communicates with slot 50 to secure the flap adjacent to the fuselage and to provide a projection for grasping by the user when launching the glider.

The particular shape of the glider, in addition to the above-described features, is uniquely adaptable to packaging items such as food products. For example, a french fry package can be adhesively attached to a flat pattern of the glider for folding and use of the glider after the contents of the package are gone, or if desired the pattern can be folded along its center hinge line to hold the package upright. Also items such as hot dogs, hamburgers or drinks in cups can be marketed by placement in the tail, thereby providing a unique promotional package, for delivery of the product.

The terms and expressions which have been employed in the forgoing abstract and specification are used therein as terms of description and not of limitation, and there is no intention in the use of such terms and expressions, of excluding equivalents of the features shown and described or portions thereof, it being recognized that the scope of the invention is defined and limited only by the claims which follow.

What is claimed is:

1. A folded glider having a leading edge and a trailing edge comprising:

(a) a center hinge line located along a medial axis of said glider;

(b) paired first side hinge lines located generally parallel to said center hinge line at spaced intervals outwardly thereof;

(c) paired second side hinge lines located generally parallel to said first side hinge lines at spaced intervals outwardly thereof;

(d) said glider defining a transfer slit extending between said second side hinge lines proximate said trailing edge;

(e) an lower fuselage located between said center hinge line and said first side hinge lines, said fuselage being formed by folding said glider upwardly along the portions of said center hinge line lying forwardly of said slit;

(f) an upper fuselage located between said first side hinge lines and said second side hinge lines, said outer fuselage being formed by folding said glider downwardly along the portions of said first side hinge lines lying forwardly of said slit;

(g) wings located adjacent to said second side hinge lines, said wings being formed by folding said glider downwardly along the portions of said second side hinge lines lying forwardly of said slit; and (h) an inverted "V"-shaped vertical tail located adjacent to said wings, said tail being formed by folding said glider upwardly along the portions of said second side hinge lines lying rearwardly of said slit, and downwardly along the portions of said center hinge line lying rearwardly of said slit.

2. A folding glider having a leading edge and a trailing edge comprising:

(a) a center hinge line located along a medial axis of said glider;

(b) paired side hinge lines located generally parallel to said center hinge line at spaced intervals outwardly thereof;

(c) said glider defining a slit extending between said side hinge lines proximate said trailing edge, said slit angling rearwardly from each of said side hinge lines to a common point along said center hinge line to form a triangular flap;

(d) said triangular flap being folded forwardly along a fold line, said fold line extending transversely of the glider between the point at which said slit intersects the respective side hinge lines, in a manner so that the portion of the center hinge line lying rearwardly of said fold line overlies the portion of said center hinge line lying forwardly of said fold line;

(e) a fuselage located between said center hinge line and said side hinge lines, said fuselage being formed by folding said glider upwardly along said overlying portion of said center hinge line;

(f) wings located adjacent to said fuselage, said wings being formed by folding said glider downwardly along the portions of said side hinge lines lying forwardly of said fold line; and (g) an inverted "V"-shaped vertical tail located adjacent to said wings, said tail being formed by folding said glider upwardly along the portions of said side hinge lines lying rearwardly of said fold line and downwardly along the portion of said center hinge line lying rearwardly of said fold line.

3. A folded glider having a leading edge and a trailing edge comprising:

(a) paired center hinge lines located parallel to and at spaced intervals from a medial axis of said glider;

(b) paired first side hinge lines located generally parallel to said center hinge line at spaced intervals outwardly thereof;

(c) paired second side hinge lines located generally parallel to said first side hinge lines at spaced intervals outwardly thereof;

(d) said glider defining a transverse slit extending between said second side hinge lines proximate said trailing edge;

(e) a triangular lower fuselage located between said center hinge lines and between said center hinge lines and said first side hinge lines, said lower fuselage being formed by folding said glider upwardly along the portions of said center hinge lines lying forwardly of said slit;

(f) an outer fuselage located between said first side hinge lines and said second side hinge lines, said fuselage being formed by folding said glider downwardly along the portions of said first side hinge lines lying forwardly of said slit;

(g) wings located adjacent to said second side hinge lines, said wings being formed by folding said glider downwardly along the portions of said second side hinge lines lying forwardly of said slit; and (h) an inverted "V"-shaped vertical tail located adjacent to said wings, said tail being formed by folding said glider upwardly along the portions of said second side hinge lines lying rearwardly of said slit, and downwardly along the portions of said center hinge line lying rearwardly of said slit.

* * * * *